US005218726A

United States Patent [19]

Jaeckels et al.

[11] Patent Number: 5,218,726

[45] Date of Patent: Jun. 15, 1993

[54] WATER CONSERVING TOILET

[75] Inventors: Norman J. Jaeckels, Sheboygan; Fred Ogreenc, Cedar Grove, both of Wis.

[73] Assignee: Kohler Co., Kohler, Wis.

[21] Appl. No.: 742,975

[22] Filed: Aug. 9, 1991

[51] Int. Cl.[5] ..... E03D 11/02

[52] U.S. Cl. ..... 4/420; 4/425

[58] Field of Search ..... 4/216, 311, 329, 330, 4/331, 332, 344, 348, 349, 420, 421, 422, 423, 424, 425, 426, 427, 428, 591

[56] References Cited

U.S. PATENT DOCUMENTS

| | | | |
|---|---|---|---|
| D. 275,598 | 9/1984 | Stairs, Jr. | D23/65 |
| 1,152,962 | 9/1915 | Muckenhirn . | |
| 1,159,445 | 11/1915 | Watrous | 4/420 |
| 1,211,137 | 1/1917 | Grant . | |
| 1,533,860 | 4/1925 | Hoge | 4/349 |
| 1,675,841 | 7/1928 | Cohoon | 4/349 |
| 1,822,378 | 9/1931 | Schossow . | |
| 1,966,786 | 7/1934 | Brain | 4/421 |
| 1,977,797 | 10/1934 | Kohler et al. | 4/420 |
| 2,156,108 | 4/1939 | Brain | 4/421 |
| 3,131,402 | 5/1964 | Roberts | 4/344 |
| 4,159,550 | 7/1979 | Tobin, Jr. | 4/421 X |
| 4,232,410 | 11/1980 | Forsbäck et al. | 4/420 |
| 4,277,854 | 7/1981 | Tsai | 4/420 |
| 4,439,874 | 4/1984 | Schrock | 4/300 |
| 4,987,616 | 1/1991 | Ament | 4/421 |

*Primary Examiner*—William A. Cuchlinski, Jr.
*Assistant Examiner*—W. Morris Worth
*Attorney, Agent, or Firm*—Quarles & Brady

[57] ABSTRACT

A water conserving toilet having a set of holes around the rim to provide a washing of the bowl includes enlarged holes towards the front of the rim to create a focused jet of water used to initiate siphon action. The enlarged holes are positioned on an elevated multi-plateau boss within the rim. The boss extends beyond the highest normal level of water in the rim and has a vent to vent air from the rim. A sloped entry within the receiving chamber connects the tank of the toilet to the rim to further increase the momentum of this water. The jet from the enlarged front holes in the rim is further focused by a groove extending on the bowl's lower wall.

6 Claims, 2 Drawing Sheets

WATER CONSERVING TOILET

BACKGROUND OF THE INVENTION

This invention relates generally to toilets and more specifically to those toilets that can remove waste from the bowl using a reduced amount of water.

In gravity feed toilets, such as are used in most residential homes and many buildings, a storage tank is prefilled from the water supply to a predetermined level and is controlled by a float actuated valve. When the toilet is flushed, a flush valve in the tank opens, releasing water to the toilet bowl. A siphon connects the lowermost "sump" portion of the toilet bowl to a drain pipe allowing the flushing water and waste to exit the toilet bowl. See e.g. U.S. Pat. No. 4,232,410.

However, an effective flushing process requires much more than simply adding water to the toilet bowl. Without a forceful siphon action, added water simply dilutes the waste. Accordingly, an effective flushing process comprises a series of stages.

During the first "siphoning" stage, a water jet, often, at least in part, from a separate orifice in the bowl positioned near the sump, imparts its momentum to the standing water and waste in the sump. See e.g. U.S. Pat. No. 3,131,402. This causes a first slug of water and waste, sufficient in amount to block the backflow of air, to proceed into the upleg of the siphon and over its verge to establish siphon action. The downleg of the siphon, attached to the drain pipe, is designed to insure that the siphon action continues until the original standing water and waste are completely drained. Continued application of more water prevents backwash from the siphon into the bowl when the siphon is broken.

The second "cleaning" stage, sometimes overlapping with the siphoning stage, involves the scrubbing of the sides of the bowl, usually by a series of cleaning streams of water directed downward into the bowl from the bowl's rim. Both the water jet and the cleaning streams are typically supplied by the stored water in the tank.

A third "seal recovery" stage refills the bowl to establish a seal of water. This water is sometimes provided directly from the water supply, the water in the tank having been exhausted during the earlier stage(s), and comes from diverting a small percentage of the water used to refill the tank directly into the bowl. For this reason, the amount of water used during seal recovery stage can be dependent on the time the tank takes to refill, a time that is often longer than optimal.

Increased interest in water conservation has led to the development of water conserving toilets which use less water, during each flush, than standard toilets. A standard residential toilet may use three and one-half gallons per flush, compared to a water conserving toilet which may reduce this amount by about half.

The amount of water needed for the "cleaning" and "seal recovery" stages of the flushing process can to some extent be reduced by controlling the size of the tank and bowl. Reducing the amount of water used in the "siphoning" stage, however, is more difficult because a minimum amount of water is normally required to achieve sufficient momentum to ensure reliable and complete emptying of the waste and water from the bowl. Reducing the flow of water during the siphoning stage of the flushing process may cause incomplete flushing.

Some solutions have involved the use of complex and relatively expensive systems in the tank to pressurize the water. Other solutions have relied on reducing water usage by techniques that significantly reduce the cleaning capacity of the bowl. In practice, users will often flush such toilets twice to achieve the desired waste removal. Other solutions made the front of the bowl appear very shallow, which gave a user the feeling that splashing might occur. Thus, a need exists for an improved low cost water conservation toilet.

SUMMARY OF THE INVENTION

The present invention provides a water conserving toilet that generates a reliable siphon action.

Specifically, the toilet has a bowl with an upper lip and a lower wall having a sump at its base. The sump is connected through a bowl outlet to a siphon for the discharge of a cleaning liquid and waste. A hollow rim, receiving the cleaning liquid, has a first and second hole in its floor and is attached to the bowl so that the cleaning liquid may pass through the holes from the rim to the bowl. The second hole is in a plateau and opens into the rim at a higher level than the first hole.

It is thus one object of the invention to provide a toilet where ample water is provided to siphon initiating jet holes, without unduly interfering with the water flowing through the other holes during the "cleaning" and "seal recovery" stages. Another object is to use a plateau structure to achieve an effective, low cost water conserving toilet.

It is yet another object of the invention to maximize the effectiveness of the flushing water, in a toilet of the above kind. This is achieved by venting air trapped within the rim through a unique multi-plateau vent, and by a focusing channel in the bowl floor.

These and other objects and advantages of the invention will be apparent from the description that follows. In the description reference is made to the accompanying drawings which form a part hereof and in which there is shown by way of illustration a preferred embodiment of the invention. Such embodiment does not necessarily represent the full scope of the invention however and reference is made therefore to the claims herein for interpreting the scope of the invention.

DESCRIPTION OF THE PREFERRED EMBODIMENT

Figure 1:
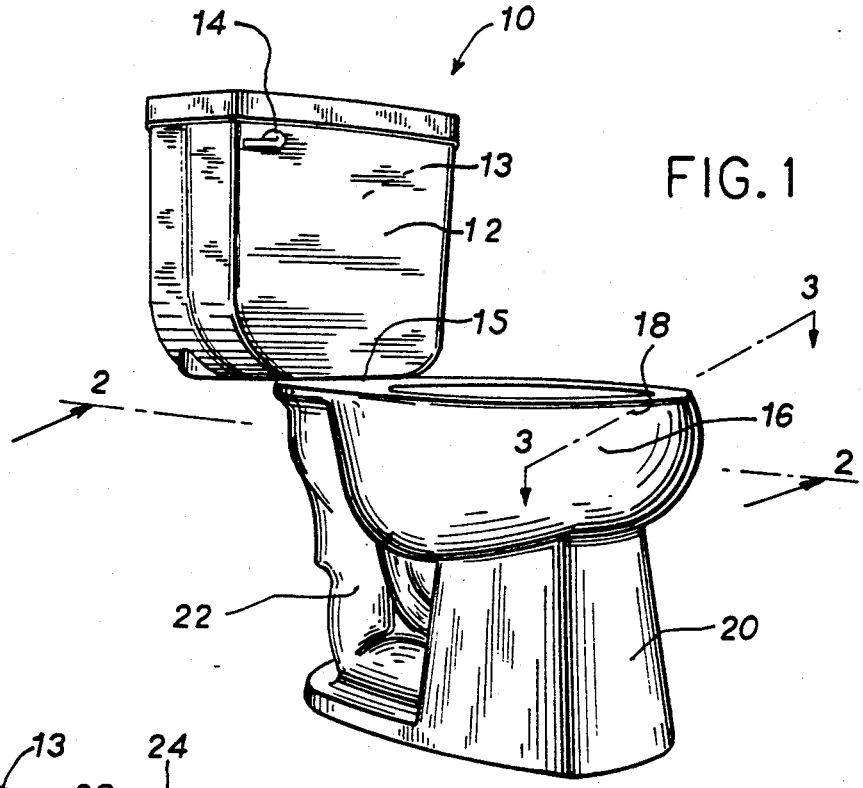
FIG. 1 is a perspective view of a preferred water conserving toilet of the present invention.

Referring to FIG. 1, a toilet 10 that conserves cleaning liquid (normally water) has a tank 12 connected to a water supply (not shown) to store water 13 between the flushing cycles of the toilet 10. The filling of the tank 12 is by processes well known in the art (e.g. a float activated inlet valve). The tank 12 is positioned on a shelf 15 at the rear, and above, an upwardly facing bowl 16.

As is well known, the tank could instead be integrally formed with the bowl. The bowl 16 is surrounded at its upper lip by a hollow rim 18.

A flush lever 14 on the tank 12 allows the toilet 10 to be flushed in the conventional manner. A skirt 20 generally supports the underside of the bowl 16 and hides a siphon trapway 22 at its rear. The siphon trapway 22 provides a passage from the bowl 16 to a vertical drain pipe (not shown) in the floor. If desired, the drain could also be formed towards a wall behind the toilet.

Figure 2:
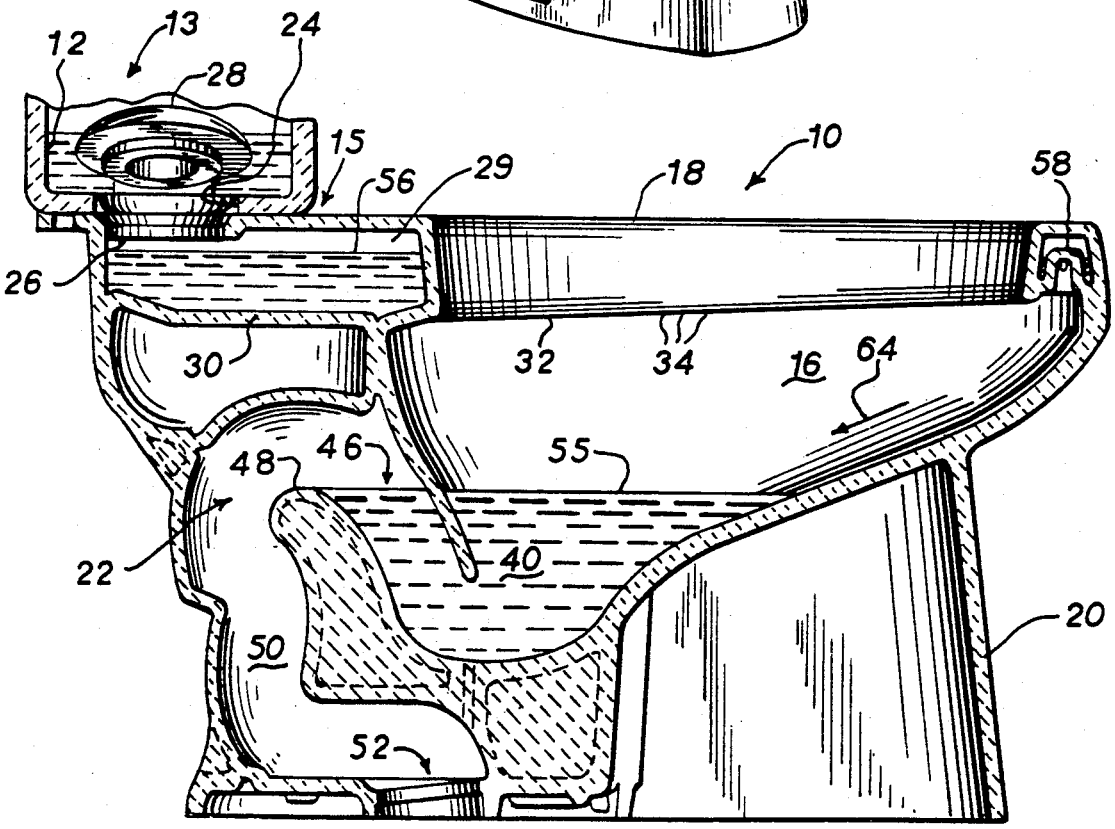
FIG. 2 is an elevational cross-section of the toilet of FIG. 1, taken along line 2—2 of FIG. 1, showing the toilet shortly after the start of the flushing process.

Referring to FIG. 2, the tank 12 has an opening 24 in its bottom wall matched to a similar opening 26 in the upper surface of the shelf 15 of the rim 18. A conventional flapper valve 28 blocks the passage formed by openings 24 and 26 in the usual manner, and is held in place over the opening 24 by the pressure of the water 13 within tank 12. As is well known, flapper valve 28 may be lifted by means of a chain (not shown) attached between the flapper valve 28 and the flush lever 14.

Beneath opening 26 in shelf 15 is a receiving chamber or entry passage 29. Water 13 passing from tank 12 through openings 24 and 26, and strikes floor 30 of the receiving chamber 29 which is sloped beneath the opening 26. This redirects the velocity of water towards the rim 18, minimizing the water's loss of momentum through turbulence (such as might be caused if floor 30 were all horizontal).

The receiving chamber 29 communicates at its front edge with the rim 18 so as to direct water along both sides of the bowl (in both a clockwise and counter-clockwise direction about the interior of rim 18) toward the front of the toilet 10.

Figure 5:
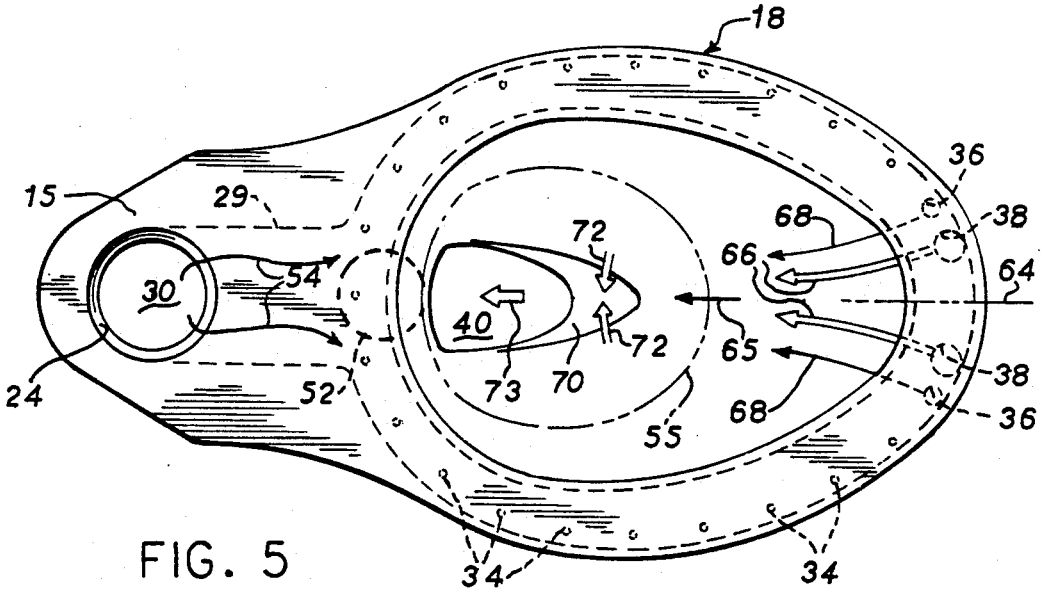
FIG. 5 is a plan view of the rim and bowl of FIG. 1.

The rim 18 has a generally rectangular cross section, on the sides of the bowl, and the lower side of the rim forms a floor 32. FIG. 5 shows that floor 32 is perforated by a plurality of holes 34, 36 and 38. The rim 18 is mounted so that the floor 32 projects inward over the bowl 16 to allow the water passing from inside the rim 18 through holes 34, 36 and 38 to flow down the inner surfaces of the bowl 16. Holes 34 produce cleaning streams 72, whereas holes 38 and 36 produce a siphon initiating jet 66 and shepherding streams 68.

Referring again to FIG. 2, the lowermost portion of bowl 16 forms a sump 40. The sump 40 is a steep depression in the inner surface of bowl 16 intended to concentrate solid waste within its volume. Sump 40 communicates with the siphon trapway 22 having a upleg 46 passing over trap verge 48 and connecting to a downleg 50 communicating with the floor drain 52. Prior to flushing the toilet 10, the sump 40 is filled with water to level 55 generally defined by the height of the trap 48. Additional water added to the bowl 16, that would raise the water level above level 55, passes over the trap verge 48 to the floor drain 52. The water in the sump 40 seals the siphon trapway 22 as is well known.

During the initial stage of the flush process, flapper valve 28 is raised by a chain attached to the flush lever 14 allowing water 13 from the tank 12 to pass down into the receiving chamber 29. The water passing through openings 24 and 26 initially strikes the sloped floor 30 of the receiving chamber 29 and is then propelled forcefully forward into the rim 18. Referring also to FIG. 5, the water from the receiving chamber 29 passes into the rim 18, as shown by arrows 54, to travel through the rim 18 in both a clockwise and counter-clockwise direction.

During this stage of the flush, the water passes with great speed to the front of the rim 18 with very little exiting through holes 34. A peak water level 56 may be identified based on the usual rest volume of the water in tank 12, the volume of the rim 18 and receiving chambers 29, and the dynamic properties of the water flowing out into the bowl 16 through the holes 34, 36 and 38.

Figure 3:
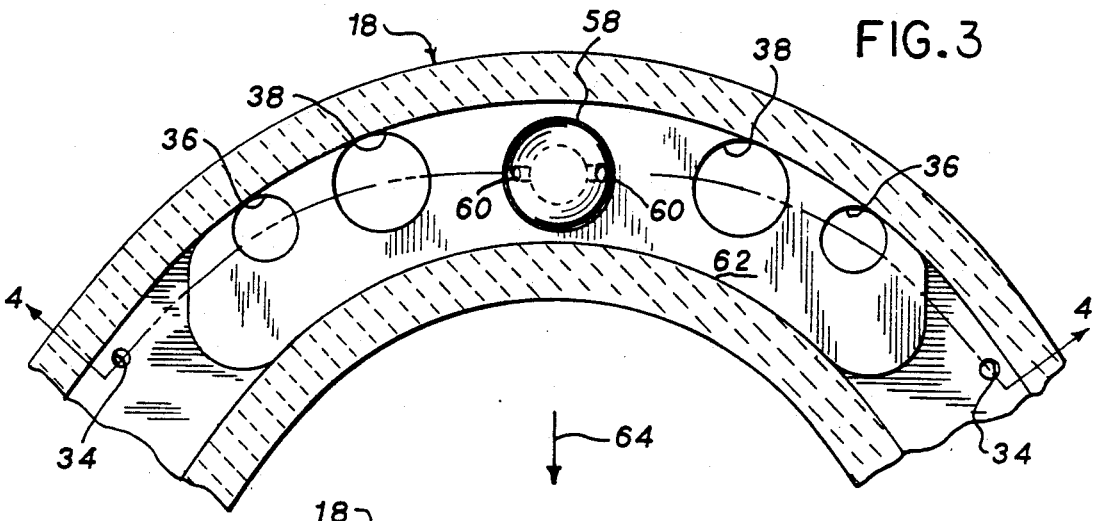
FIG. 3 is a top plan, cross-sectional view of the front of the rim of FIG. 2, taken along line 3—3 of FIG. 1, showing a vent hole and an enlarged set of four holes on a multi-plateau boss.
Figure 4:
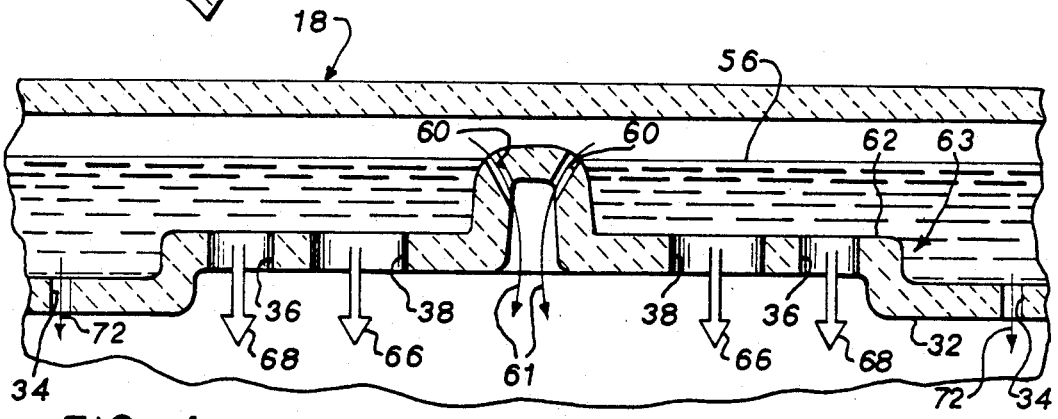
FIG. 4 is a vertical cross-section of the portion of the rim shown in FIG. 3, taken along curved line 4—4 of FIG. 3.

Referring now to FIGS. 3 and 4, a multi-plateau boss 58 rises above the floor 32 of the rim 18. Two vent holes 60, cut through the boss 58, provide a passage from inside the rim 18, above the peak water level 56, to outside the rim 18 beneath the floor 32 to the bowl 16. These holes 60 allow the passage of air 61 from inside the rim 18 to outside of the rim 18, unobstructed by flowing water. In particular, during the initial rush of water from the receiving chamber 29, a high flow rate of water from the tank 12 through the receiving chamber 29 and into the rim 18 is critical to producing an initial surge of water that will quickly create the needed siphon initiating jet stream 66. However, air must exit the rim for this to occur. The exiting air can, if not properly vented, delay needed water from reaching the front exit hole.

Note that the boss 58 is positioned within the rim 18 opposite the receiving chamber 29 and approximating the point at which the bifurcated streams of water from the receiving chamber 29 meet after passing in counter-clockwise and clockwise direction through the rim 18.

The second plateau 62 on the boss rises from the floor 32 of the rim 18 and holds the set of holes 36 and 38 that are used to create the siphon initiating jet stream 66. The radii of holes 36 and 38 are substantially larger than the radius of holes 34.

The holes 36 and 38 are positioned on the plateau 62 so that they open within the rim 18 at a threshold height 63 above the floor 32, but lower than the peak water level 56. When water fills the rim 18 from the tank 12 during the flush, the water should exceed the height of the plateau 62 for the siphoning stage, allowing water to flow through holes 36 and 38. Later during the cleaning stage of the flushing process, when the siphon inducing jet stream 66 is not needed, the water level within the rim 18 will have dropped below the threshold height 63 and water will abruptly cease flowing through holes 36 and 38. This quick shut off optimizes water usage.

In this regard, the sides of the plateaus are substantially vertical. Thus, not only does the water flowing through holes 36 and 38 stop relatively abruptly at the end of the siphoning stage, but for the period of time during the cleaning and seal recovery stages, when the water is below the height 63, the holes 34, not on the boss, remain covered by an ample height of water. This insures substantially equal flow 72 among the holes 34 for a period of time.

Referring to FIGS. 2, 3 and 4, plateau 62 is centered along a longitudinal discharge axis 64. Preferably this is the same axis that the water from the bowl 16 follows into the upleg 46 of the siphon trapway 22. The vector 65 describes the vector of momentum which must be absorbed from the jet stream 66 by the water and waste in the sump 40, to best accelerate that water and waste in a sufficient slug up into the siphon 42. Accordingly, water flowing through holes within the boss 62, down the bowl 16, is positioned to provide the desired high momentum jet stream 66.

As mentioned, holes 38 are larger than holes 36. This insures that the jet streams 66 can promptly start the siphon action for the siphoning stage of the flush. Holes 38 are positioned closest to the discharge axis 64 and symmetrically on either side of the discharge axis 64 to best align the momentum of the jet stream 66 with the discharge axis 64. Flanking the holes 38, and are further removed from the discharge axis 64, are smaller diametered holes 36. Holes 36 create shepherding streams of water 68 which serve to contain the spread of the jet streams 66 and thus to focus the jet streams 66 into a single high momentum jet. It has been determined that the smaller radius of the holes 36, still larger than holes 34, provides a savings in water without substantially reducing the effectiveness of this shepherding.

Referring to FIG. 5, for ease of manufacturing, the holes 36 are cut straight through the lower plateau 63 and thus do not provide significant direction to the shepherding streams 68. Nevertheless, the shepherding streams 68 angle in towards the streams 66 and the discharge axis 64 to perform the shepherding function, both because of the retained momentum of the rushing of the water through the rim 18 and the increased component of inward curvature of the bowl 16 with the displacement of the shepherding streams 68 from the discharge axis 64.

The combined streams 66 and 68 are focused into an even more concentrated jet 73 by focusing groove 70. Preferably the groove is in converging form (e.g., a V-shape trough). The groove extends from a point just below the seal recovery water level 55 to the sump 40. The depression of the focusing groove 70 diverts the cleaning streams 72 from holes 34, concurrent with the jet and shepherding streams 66 and 68, to a direction more perpendicular to the discharge axis 64, thus serving to compress the flow of streams 66 and 68 at groove 70 into a compact, high momentum jet 73. This compact jet 73, impinging upon the water and waste collected in sump 40, insures that a substantial volume of water is accelerated up the upleg 46 of the siphon trapway 22 and down the downleg 50.

Once the siphoning stage of the flushing process is complete, water drains in cleaning streams 72 out of the rim 18, through holes 34 only. This is because the water level in the rim 18 will have dropped below the threshold height 63 of plateau 62. The prevention of additional flow of water out of holes 36 and 38 by plateau 62 ensures that a sufficient volume of water for the cleaning and seal recovery stages will be available through holes 34, without the use of additional water from the supply lines feeding the toilet 10, as is conventionally done in standard toilets.

The water used during the cleaning and seal recovery stages of the flushing process is controlled by adjusting the volume in the rim 18 between the floor 32 and the threshold height 63. In a standard toilet, in which water for the cleaning and seal recovery is obtained from the supply lines during the refilling of tank 12, this volume of water used during these stages is not well controlled, causing wasted water.

Likewise, the water used during the siphoning stage of the flushing process may be accurately determined by adjusting the distance between the peak water height 56 and the top of boss 62 so as to ensure that just enough water is present in rim 18 to provide adequate siphoning action.

While a preferred embodiment of the invention has been described, but it should be apparent to those skilled in the art that many variations can be made without departing from the spirit of the invention.

We claim:

1. A toilet, comprising:

a bowl having an upper lip and a lower wall having a sump portion at its base, the sump portion being connected through a bowl outlet to a siphon for the discharge of cleaning liquid and water from the bowl;

a hollow rim for receiving cleaning liquid, the rim having a floor adjacent to the upper lip of the bowl, the rim being constructed and arranged to allow passage of cleaning liquid into the bowl through a plurality of first holes in the floor and a plurality of second holes in the floor;

a raised plateau forming a part of the floor of the rim adjacent to the front of the bowl;

wherein the first plurality of holes are not formed in the plateau, the second plurality of holes are formed in the plateau, and the second plurality of holes open inside the rim at a higher level than the first plurality of holes open inside the rim;

wherein said second plurality of holes comprises at least one hole which has a larger opening than a group of second holes, said second plurality of holes being positioned to provide a jet of cleaning liquid and shepherding streams for initiating the siphon for the discharge of cleaning liquid and waste from the bowl.

2. The toilet of claim 1, wherein there is at least one additional plateau formed on the floor of the rim, one of said plateaus being higher than the other, and both being higher than the adjacent floor of the rim, wherein a vent hole opens into the rim through the higher plateau to permit the passage of air out of the rim as water enters the rim.

3. The toilet of claim 2, wherein the vent hole is positioned adjacent the front of the rim.

4. The toilet of claim 1, wherein the bowl lower wall has a longitudinal focusing groove extending from the sump towards the front rim.

5. The toilet of claim 1, further comprising a tank for storing a volume of cleaning liquid between flushes, said tank communicating with the rim through a substantially horizontal feeding passage.

6. The toilet of claim 5, wherein an entry portion of a floor of said feeding passage is sloped downwards towards the rim.

* * * * *

UNITED STATES PATENT AND TRADEMARK OFFICE

CERTIFICATE OF CORRECTION

PATENT NO. : 5,218,726

DATED : June 15, 1993

INVENTOR(S) : Norman J. Jaeckels & Fred Ogreenc

It is certified that error appears in the above-indentified patent and that said Letters Patent is hereby corrected as shown below:

TITLE PAGE

Please delete: "Kohler Co., Kohler Wis." and insert --Sterling Plumbing Group, Inc., Kohler Wis.--.

Signed and Sealed this

Thirty-first Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,218,726

DATED : June 15, 1993

INVENTOR(S) : Jaeckels et al.

It is certified that error appears in the above-identified patent and that said Letters Patent is hereby corrected as shown below:

On the title page, Item [73]:

delete "Sterling Plumbing Group, Inc., Kohler, Wis." and

Insert --Sterling Plumbing Group, Inc., Schaumberg, IL--

Signed and Sealed this

Sixth Day of September, 1994

*Attest:*

Bruce Lehman

BRUCE LEHMAN

*Attesting Officer*

*Commissioner of Patents and Trademarks*